United States Patent [19]

Scardino

[11] 3,999,751

[45] Dec. 28, 1976

[54] BALLOON CARROUSEL

[76] Inventor: Georgeanna B. Scardino, 2506 Neyrey Drive, New Orleans, La. 70001

[22] Filed: June 17, 1975

[21] Appl. No.: 587,541

[52] U.S. Cl. ..... 272/31 R; 272/38

[51] Int. Cl.[2] ..... A63G 1/10; A63H 27/10

[58] Field of Search ..... 272/31 R, 31 A, 31 B, 272/31 P, 6, 7, 36, 39, 40, 42; 46/87, 88, 89, 74 R, 74 D, 75, 77

[56] References Cited

UNITED STATES PATENTS

| | | | |
|---|---|---|---|
| 1,039,476 | 9/1912 | Austin | 272/31 A X |
| 2,572,859 | 10/1951 | Hall | 272/40 X |

FOREIGN PATENTS OR APPLICATIONS

| | | | |
|---|---|---|---|
| 155,450 | 5/1883 | France | 272/49 |
| 1,130,535 | 10/1956 | France | 272/38 |
| 1,057,933 | 5/1959 | Germany | 272/31 R |
| 695,062 | 8/1953 | United Kingdom | 272/31 B |
| 19,574 | 10/1893 | United Kingdom | 272/49 |
| 19,583 | 8/1913 | United Kingdom | 272/31 A |

*Primary Examiner*—Anton O. Oechsle
*Assistant Examiner*—Arnold W. Kramer
*Attorney, Agent, or Firm*—Llewellyn A. Proctor

[57] ABSTRACT

A balloon carrousel, or apparatus, useful as a toy, or amusement park facility for the transport of people comprising an aerostat or balloon, provided with an appended basket or gondola, permanently tethered via a rigid rod, or arm, to a stationary platform. The rod is pivotally attached to the balloon and to a rotatable member located on the stationary platform. Motor means are provided to actuate, control and drive the rotatable member on lift of the balloon, transport the balloon through a circular overhead pattern, and then return it to ground position.

7 Claims, 3 Drawing Figures

BALLOON CARROUSEL

FIELD OF THE INVENTION

The present invention relates to a balloon carrousel, or apparatus, useful as a toy in small scale, but also useful on large scale for the transport of people as in an amusement park type of operation.

The primary objective of the present invention is to provide a new and improved balloon carrousel useful as a toy, or as an amusement park transport device to provide entertainment.

Another object is to provide an electro mechanically operated balloon carrousel with an aerostat or balloon portion adapted to be lifted from the ground and, while tethered to a stationary platform, transported through a preselected circular route, and then returned to ground position.

A specific object is to provide a balloon carrousel, in the form of a toy which can be operated by small children as an entertainment or educational device.

Another specific object is to provide a balloon carrousel suitable for manufacture on large scale as an amusement park device for the transport of people.

A further object is to provide a new and improved balloon carrousel which is easy to fabricate at low cost, and easy to operate.

These and other objects are achieved in accordance with the present invention, consisting of a balloon carrousel or apparatus which is comprised of an aerostat or balloon, preferably one provided with a basket appended thereto by cords or strings, a stationary base to which the balloon is tethered by a rigid rod, an end of which is pivotally attached to a portion of the balloon or basket appended thereto and the other of which is mounted on a pivotable member associated with the stationary base, and motor means for driving and rotating the said pivotable member. Suitably, the aerostat or balloon is a bag or envelope of impermeable material which can be inflated with a gas lighter than air. To "launch" the balloon, ballast is jettisoned via an appropriate mechanism and the balloon will then rise in the air, or can be mechanically lifted to the extent permitted by the stationary base to which the balloon is tethered. Once airborne, the motor means can be actuated to produce rotation of the said pivotable member associated with the base to move the balloon through a circular pattern. Switch means associated with said motor means can be employed to interrupt the circular movement of the balloon and return it to its starting position after a single, or preselected number of complete rotations, if desired.

The invention, and its principle of operation, will be more fully understood by reference to the following detailed description of a specific and preferred embodiment, and to the attached drawing to which reference is made in the description. In the description, similar numbers are used to designate specific parts or components.

Figure 1:
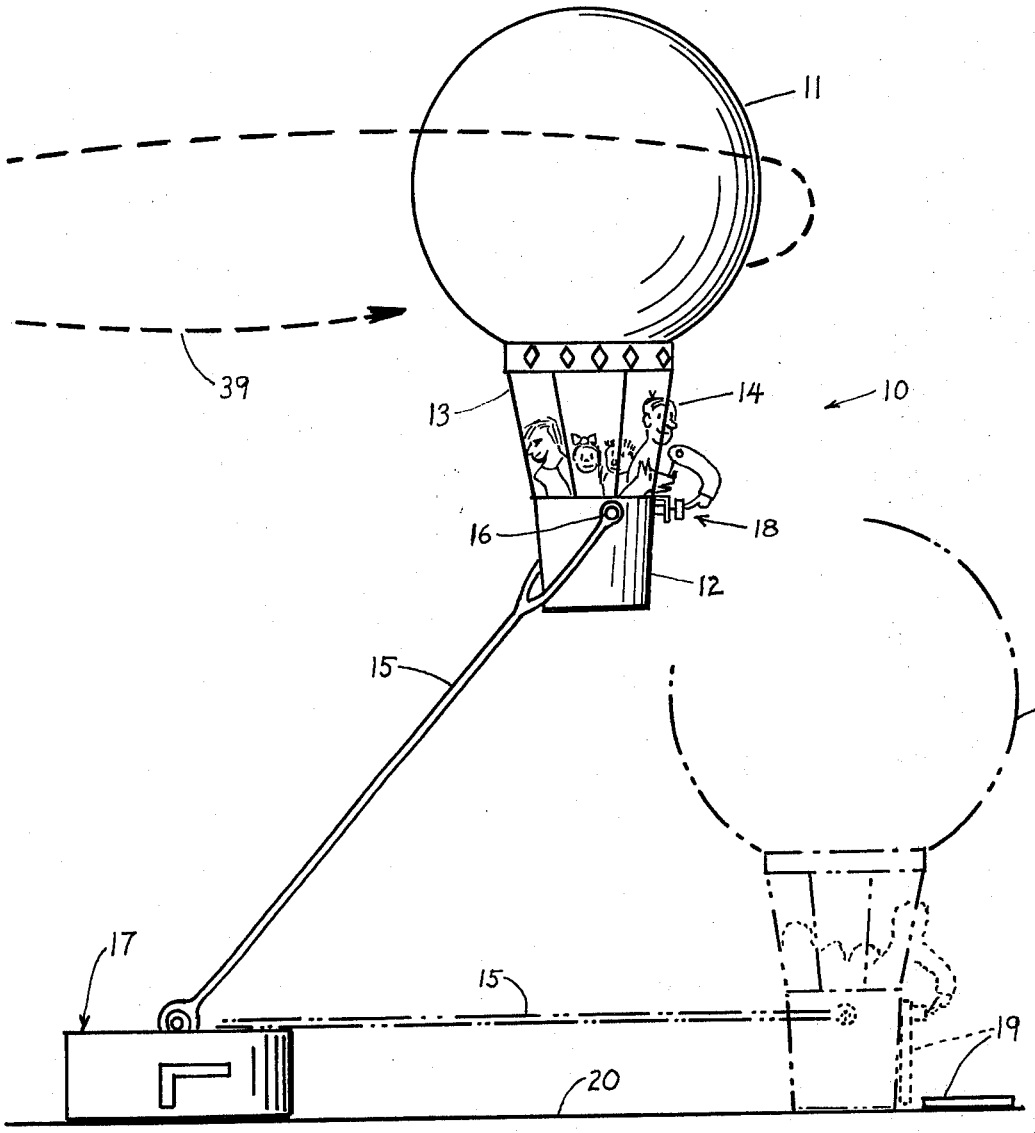
FIG. 1 depicts a side elevation view of a preferred type of balloon carrousel, the starting position of the aerostat or balloon portion of the balloon carrousel, prior to lift-off, being designated by the dotted outline.
Figure 2:
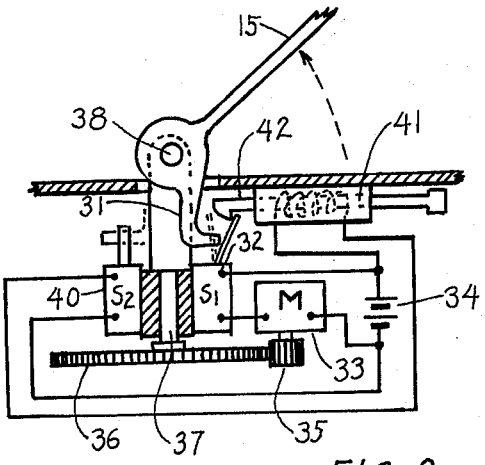
FIG. 2 is an enlarged fragmentary cross-sectional view showing a preferred type of motor means, viz., a electromechanical motor that automatically drives the balloon in a horizontally circular course after lift-off, the balloon being driven through a single rotation, after which time it is caused to descend to its original position.
Figure 3:
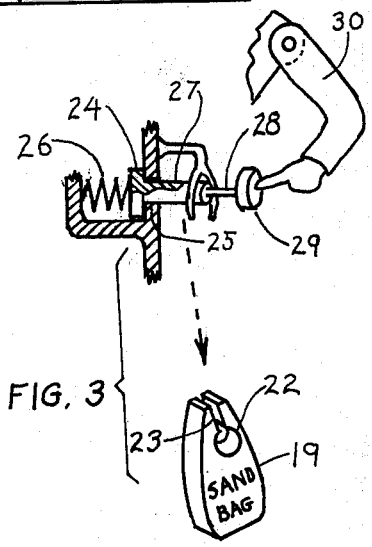
FIG. 3 is a fragmentary view, in partial section, of a preferred ballast release mechanism, actuation of which initiates the operation of the balloon carrousel.

Referring first to FIG. 1 which depicts a preferred type of balloon carrousel 10, there is shown generally an aerostat or balloon 11, in inflated mode, suitably of spherical shape and provided with an open basket 12 appended underneath the balloon 11 via cords or strings. The balloon 11 is tethered via a rigid rod 15 to a stationary base 17, one end of the rod 15 being bifurcated or forked with the terminal portions of said yoke-like member being provided with openings for pivotal attachment via a suitable pin 16 passed through said openings and the basket 12. The other end of the rod 15 is attached via a pin 38 passed through an opening in its terminal end to a pivotable member or shaft 37, suitably located within the stationary base 17. A preferred motor means comprises an electro-mechanical motor (FIG. 2), which can be actuated by jettison of ballast via use of a preferred type of ballast release mechanism (FIG. 3).

The balloon 11 is constituted, as suggested, of a bag or envelope of material, e.g., rubber, that is impervious to the lighter-than-air gas, e.g., helium, that is to be used to fill the member. The lower side of the material constituting the balloon 11 is secured to a strip of material bent in circular form, and therebelow supported and maintained in properly oriented position via cords or strings 13 is suspended an open basket 12 within which, when the balloon carrousel is employed as a toy, can be provided a plurality of figurines 14 which as shown represent a family consisting of a mother, a father, a boy and a girl, and also a pet such as a dog.

The balloon is tethered to a pivotable member 37 located on the stationary base 17 via a rigid rod 15, suitably constituted of a stiff plastic and preferably of metal. One end of the rod 15 is bifurcated, and the terminal ends of the yoke-like portion of the member is provided with openings. A pin 16 passed through these openings and an opening through the basket 12 in alignment therewith provides suitable pivot means for raising and lowering the balloon 11 as occurs on ascent and descent of this member.

In playing, the balloon carrousel 10 is actuated as by a child and set in motion by the release of ballast from the balloon 11, or basket 12. Before launching, the balloon is "weighed-off" by a preselected ballast weight which is just adequate to keep the balloon grounded. Release of the ballast causes the balloon to ascend from its ground or floor position 20. A suitable ballast release mechanism 18 is described by specific reference to FIGS. 1 and 3. The mechanism 18, incorporated within the basket 12, is structured to detachably hold a weight 19 sufficient to overcome the buoyancy of the inflated balloon and thus prevent it from being lifted off the ground or floor 20. The mechanism 18 is further designed to give the impression that the father figurine initiates the flying of the balloon by releasing the weight 19, this providing the illusion that a sand bag is being released. The weight 19 is imprinted with the word "sand bag" as shown in FIG. 3 so as to further convey this illusion. The weight 19, it will be observed, includes a relatively large diameter central opening 22 therethrough that is directly communicated with a narrow slot 23, the slot opening out on an upper end or edge of the weight.

The ballast release mechanism 18 includes a spring loaded pin 24 horizontally slidably mounted within an opening 25 within the wall of the basket 12. The inward side of the pin 24 is provided with an enlarged head which retains and keeps the pin seated within the opening 25. A helical coil or compressed coil spring 26, seated between the inside wall of the basket 12 and a flange or bracket mounted upon the inside wall of the basket 12, urges the pin 24 outwardly. The pin 24 includes a large diameter portion 27 approximating the inside diameter of the opening 22 of the weight 19, and it is slidable within the circular opening 22 of the weight. The pin, it will be noted, also includes a diametrically narrow portion 28 which is thin enough to slide or pass through the slot 23 of the weight. The terminal end of the pin includes a push button 29 against which a pivotable arm 30 of the father figurine 14 can be pushed when a child manually pivots the arm 30 to create the illusion that the father acts to actuate ascent of the balloon.

Prior to actuation of the balloon carrousel, the balloon is retained in a descended position upon the floor or ground 20 by the weight 19 which is suspended upon the large diameter portion 27 of the pin 24 which extends through the opening 22. However, when the button 29 is depressed so that the pin 24 compresses spring 26, the large diameter portion 27 slides horizontally inwardly into the opening 25 within the wall of the basket 12 so that the weight 19, which is no longer supported upon the wide diameter portion of the pin 24, is then caused to fall away as shown by the broken arrow since the narrow diameter portion 28 slips through the narrow slot 23. The weight 19 thus released, the balloon is sufficiently light in weight so that it can begin its ascent.

Ascent of the balloon 11 actuates the motor means located in the stationary base 17. These means, it will be observed, comprise a rotatable shaft 37 having an enlarged upper end and a lower end of reduced diameter journalled within a bearing element located between alternately disposed switches 32,40 (or $S_1$ and $S_2$). The upper enlarged end of shaft 37 is provided with a terminal opening, as is the terminal end of rod 15, through which aligned openings a pin 38 can be passed to provide a pivotable connection between rod 15 and shaft 37. The terminal end portion of rod 15, additionally, is provided with a shank or finger 31 for actuation of the motor means via contact with switches 32,40. An electric motor 33 (or M), within circuit with a battery 34, is coupled or geared via a spur gear 35 to a drive gear 36 located upon the lower end of shaft 37 such that activation of the motor circuit can rotate the shaft 37. A solenoid 41, which can be actuated by contact switch 40, is also included within the circuit. The solenoid plunger 42, it will be observed, includes a hook on its terminal end for temporary engagement with the toggle of switch 32 so that the circuit to the motor can be maintained, even when the finger 31 has at the time rotated away from the switch. But subsequent movement of the plunger 42 against the finger 31 such as to lower the rod 15 causes the release of the toggle and the cut-off of switch 32 to shut off the motor 33.

In operation, as balloon 11 ascends, since it is tethered via the rod 15 to the stationary base 17 by attachment to the rotatable shaft 37, the opposite end of the metal rod 15 pivots the finger 31 integral therewith, against the toggle portion of switch 32. This occurs when the balloon 11 has achieved its maximum ascent, this causing closure of a circuit between electric motor 33 and battery 34. The motor, thus activated, drives gear 35 and gear 36 located on shaft 37. The shaft 37 accordingly begins to rotate so that the balloon 11 travels on the circular course as schematically indicated by the dotted looped arrow 39 shown in FIG. 1. The balloon completes a full circle of travel after which time the finger 31 integral with rod 15 strikes against a toggle portion of switch 40 located adjacent the starting switch 32. The switch 40, being within an electric circuit with solenoid 41, activates the solenoid 41. Activation of solenoid 41, which includes a plunger 42, causes plunger 42 to push against the finger 31 thus causing the arm 15 to pivot downwardly to bring the balloon back to the ground or floor 20. A cycle of the trip scheduled for the balloon is thus completed.

It is apparent that various modifications and changes can be made, e.g., as in the size, shape and materials of construction, without departing the spirit and scope of the invention. If desired, the balloon can be lifted by mechanical means without dependence on the buoyancy provided by a lighter-than-air gas.

Having described the invention, what is claimed is:

1. A balloon carousel useful as a small or large scale device for amusement and educational purposes comprising a balloon inclusive of a bag constructed of a material impervious to a lighter-than-air gas which can be used to fill the bag and provide buoyancy, a stationary platform provided with a rotatable member, a rigid rod one end of which is pivotally connected to the balloon, and the other end of which is provided with a finger and pivotally connected to the rotatable member located on the stationary platform, motor means associated with said rotatable member located on the stationary platform for driving said rotatable member, and rigid rod secured thereto, ballast located on said balloon sufficient to ground said balloon, but for the presence of which the balloon can ascend from ground to an overhead position due to its buoyancy, ballast release means suitable for release of the ballast to produce ascent of the balloon from ground to overhead position, lift of the rigid rod from which the balloon is tethered to the rotatable member and stationary platform, and effect movement of said finger, a first electrical circuit providing a first switch which can be actuated by the finger of the rigid rod on ascent of the balloon which brings the finger into contact with said first switch to electrically operate and energize said first electrical circuit thereby starting the motor means so that it can drive the rotatable member located on the platform and move the rigid rod and balloon through a circular path, and a second electrical circuit providing a second switch which can be contacted and actuated by the finger of the rod, the actuation of said second switch de-energizing said first circuit by actuation of a solenoid, the plunger of which contacts and cuts off the first switch and pushes against the finger to return the rigid rod to its starting position and produce descent of the balloon.

2. The apparatus of claim 1 wherein the balloon is provided with an appended open basket, suspended therefrom by cords.

3. The apparatus of claim 2 wherein the basket contains figurines.

4. The apparatus of claim 2 wherein the basket is provided with ballast release means, by virtue of which a weight can be released to permit the balloon to ascend to an overhead position and lift the rigid rod from which the balloon is tethered to the rotatable member located on the stationary platform.

5. The apparatus of claim 1 wherein the ballast release means is constituted of a plunger, a portion of which is of relatively large diameter with a portion of reduced diameter, slidably permanently mounted within an opening within the wall of a basket appended to the balloon, the plunger is spring loaded and normally thrust outwardly, and a ballast weight is provided with a central opening corresponding in diameter with the enlarged portion of said plunger and an adjacent notch of small diameter corresponding with the reduced diameter portion of said plunger, whereby the ballast weight can be suspended upon the basket by passage of the large diameter portions of the plunger through the central opening of the ballast weight, and released by projection of the plunger within the wall of the basket.

6. The apparatus of claim 1 wherein the motor means and electrical circuitry associated therewith are contained within the stationary platform, and a terminal end of the rotatable member to which an end of the rigid rod is pivotally attached is extended outside the stationary platform.

7. The apparatus of claim 1 wherein the motor means and rotatable member are associated via a gear arrangement, a spur gear associated with the motor means which is geared to a drive gear associated with the rotatable member.

* * * * *